United States Patent [19]

Yokoyama

[11] Patent Number: 4,974,885

[45] Date of Patent: Dec. 4, 1990

[54] DEVICE FOR LOCKING TRUNK LID OF MOTOR VEHICLE

[75] Inventor: Yutaka Yokoyama, Tokyo, Japan

[73] Assignee: Fuji Jukogyo Kabushiki Kaisha, Tokyo, Japan

[21] Appl. No.: 429,382

[22] Filed: Oct. 31, 1989

[51] Int. Cl.[5] ..... E05C 3/26

[52] U.S. Cl. ..... 292/201; 292/341.16; 292/DIG. 43

[58] Field of Search ..... 292/201, 216, DIG. 43, 292/341.16

[56] References Cited

U.S. PATENT DOCUMENTS

| | | | |
|---|---|---|---|
| 3,312,491 | 4/1967 | Peters | 292/341.16 X |
| 3,378,291 | 4/1968 | Brian | 292/DIG. 43 X |
| 3,504,511 | 4/1970 | Allen | 292/DIG. 43 X |
| 3,664,698 | 5/1972 | Stropkay | 292/201 |
| 3,835,678 | 9/1974 | Meyer et al. | 292/341.16 X |
| 4,007,955 | 2/1977 | Kobayashi | 292/DIG. 43 X |
| 4,322,959 | 4/1982 | Mochida | 292/DIG. 43 X |
| 4,395,064 | 7/1983 | Bellot et al. | 292/201 |
| 4,652,027 | 3/1987 | Quantz | 292/DIG. 43 X |
| 4,815,775 | 3/1989 | Mertin et al. | 292/201 |
| 4,906,035 | 3/1990 | Nagai et al. | 292/216 |

FOREIGN PATENT DOCUMENTS

| | | | |
|---|---|---|---|
| 59-65165 | 5/1984 | Japan . | |
| 5827457 | 5/1987 | Japan | 292/341.16 |
| 63-30357 | 3/1988 | Japan . | |

*Primary Examiner*—Eric K. Nicholson

*Attorney, Agent, or Firm*—Beveridge, DeGrandi & Weilacher

[57] ABSTRACT

A device for locking a trunk lid of a motor vehicle comprises a base plate secured to a trunk structure, a latch member rotatively supported on the base plate for holding a striker secured to the trunk lid, and a detent lever being engageable with the latch member to hold the latch member in a locking position. Furthermore, the device has a lock lever for rotating the latch member and the detent lever. When the trunk lid is closed, the lock lever rotates the latch member to move the striker in a locking position. When the trunk lid is opened, the lock lever rotates the detent lever to release the detent lever from the latch member.

3 Claims, 2 Drawing Sheets

DEVICE FOR LOCKING TRUNK LID OF MOTOR VEHICLE

BACKGROUND OF THE INVENTION

The present invention relates to a device for locking the trunk lid of a motor vehicle.

Many motor vehicles have trunks with lids at their rear parts. A locking device is known which can be operated by a switch provided in the vehicle interior to unlock and release the trunk lid. One example is that disclosed in Japanese Laid Open Utility Model Publication No. 65165/1984. When the switch is manipulated, it actuates a solenoid or a motor to swing a detent lever of the locking device. As a result, a striker is released from an engagement slot formed in a latch member. Thus the trunk lid to which the striker is attached is released.

With a conventional locking device, however, the action of closing the trunk lid is resisted by a number of reactionary forces. One of these forces is that required to compress a trunk lid or a weather strip provided in the peripheral edge of the trunk lid. Another is the reaction of a spring which must be overcome by the striker being pressed into the engagement slot of the latch member to cause the latch member to rotate, and thereby engage with the detent lever.

Consequently, a great force must be applied to close the trunk lid because of the reactions of the weather strip, the spring, and so on. This has given rise to problems such as difficulty in closing the trunk lid.

Accordingly, there has previously been proposed a device for locking trunk lids of motor vehicles by which the force required to close the trunk lids is reduced. This conventional device is disclosed in Japanese Utility Model Application No. 30357/1988 filed by the present applicant.

FIG. 4 and 5 shows this conventional device. In FIG. 4 and 5, a locking mechanism 15 is secured to a rear edge part of a trunk structure of the motor vehicle. The striker 12 which engages with the locking mechanism 15 is secured to the rear edge part of the trunk lid 11. A key type unlocking mechanism 14 is secured next to the locking mechanism 15. A sensor (not shown) is provided to detect the position to which trunk lid 11 is lowered in closing motion.

On the basis of a signal from the sensor, a motor M is operated to rotate the latch member 2 by a inner cable 19. At this time, the striker is fitted in the engagement slot 2*a* of the latch member. The latch member is thus rotated forcibly and moves the striker far into a guide slot formed in the base plate of the device. Then, the latch member is caught and stopped by the detent lever 6. The inner cable 19 returns to a first position by operating the motor M in the reverse direction.

On the other hand, the motor M is operated in the reverse direction on the basis of unlocking signals from the key type unlocking mechanism or from a lid opening switch (not shown) provided in the vehicle interior. The detent lever 6 swings and is then released from the latch member 2. The inner cable returns to the first position by operating the motor M in the forward direction. As mentioned above, when the trunk lid is closed, the latch member is driven by the motor and forcibly moves the striker down. The lid closing force is therefore reduced. On the other hand, when the trunk lid is opened, the motor M is operated in the reverse direction to rotate the detent lever through the inner cable.

The detent lever swings and is released from the latch member.

In spite of the improvement afforded by the above described locking device, the following problems remain.

Cables are provided in the latch member and in the detent lever respectively. The locking operation or the unlocking operation of the locking device are made through the cables by operating the motor in the forward or reverse directions. The structure of the locking device is therefore complicated, and the problem of the lack of reliability of the mechanical operation remains because it is required to provide escape slots both in the connecting portion between the latch member and the cable, and in the connecting portion between the detent lever and the cable.

SUMMARY OF THE INVENTION

It is an object of the present invention to provide an automatic device for locking a trunk lid of a motor vehicle in which the locking operation of the trunk lid is reliably made with a reduced lid closing force, the locking mechanism and the unlocking mechanism are simple, reliability of the mechanical operation is enhanced, and the manufacturing cost is low.

According to the present invention, there is provided a device for locking a trunk lid of a motor vehicle comprising: a base plate secured to a trunk structure of the vehicle and provided with a guide slot for receiving a striker secured to the trunk lid; a latch member rotatively supported on the base plate and provided with an engagement slot for functioning cooperatively with the guide slot to hold the striker; a detent lever pivotally supported on the base plate and engageable with the latch member to hold the latch member in a locking position; a lock lever pivotally supported on the base plate for rotating the latch member by pressing a contact surface of the latch member, alternately rotating the detent lever by pressing a contact surface of the detent lever; a motor for driving the lock lever in the forward and reverse directions through a connecting mechanism; a striker monitoring sensor for monitoring a fitting position of the striker in the engagement slot when the trunk lid is closed, the sensor sending the monitoring signal to the motor to rotate the latch lever through the lock lever driven in the forward direction, and to thereby move the striker along the guide slot until the latch member is locked to the detent lever; a lid opening switch for sending an opening signal to the motor to rotate the detent lever through the lock lever driven in the reverse direction, and to release the detent lever from the latch member.

The preferred embodiments of the present invention will become understood from the following detailed description referring to the accompanying drawings.

DETAILED DESCRIPTION OF THE PREFERRED EMBODIMENTS

Figure 1:
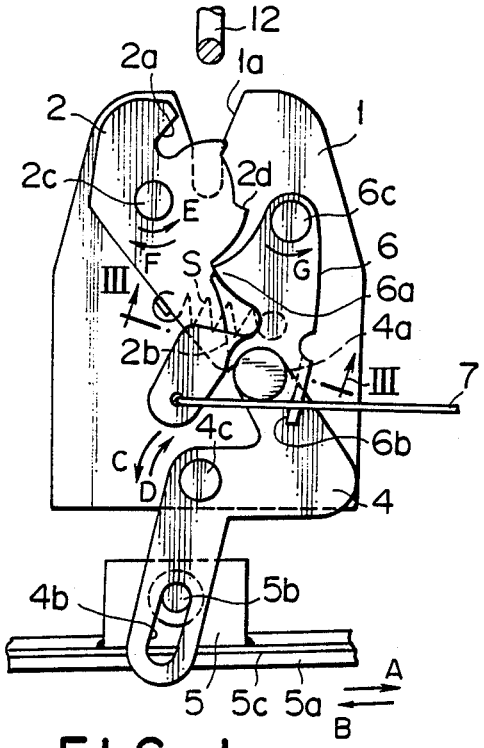
FIG. 1 is a general view of a device for locking a trunk lid of a motor vehicle according to the present invention.
Figure 3:
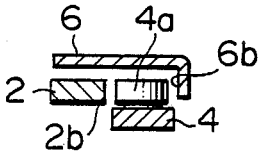
FIG. 3 is a cross-sectional view along line III—III of FIG. 1.
Figure 2:
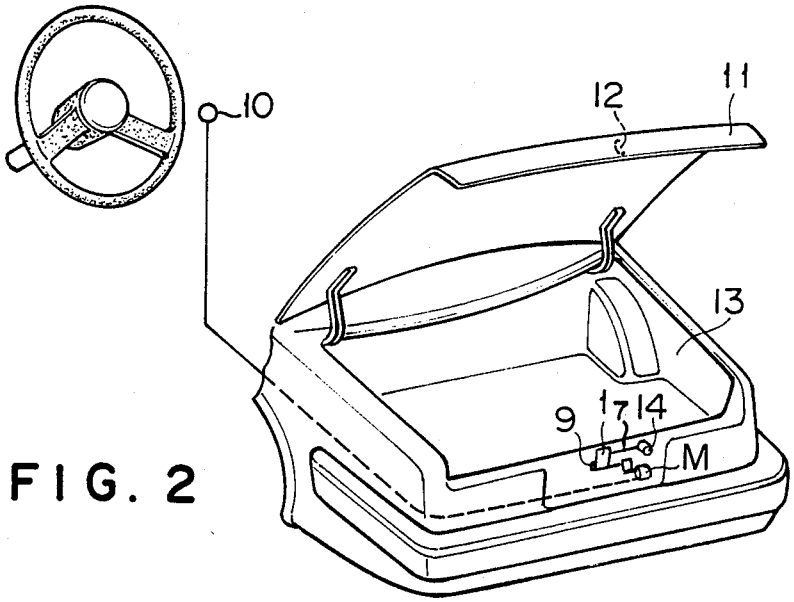
FIG. 2 is a perspective view showing the device installed on a trunk structure and the trunk lid of the motor vehicle.

An embodiment of the device for locking the trunk lid of a motor vehicle of the present invention will become understood from the following detailed description referring to the accompanying drawings, FIGS. 1-3.

Figure 4:
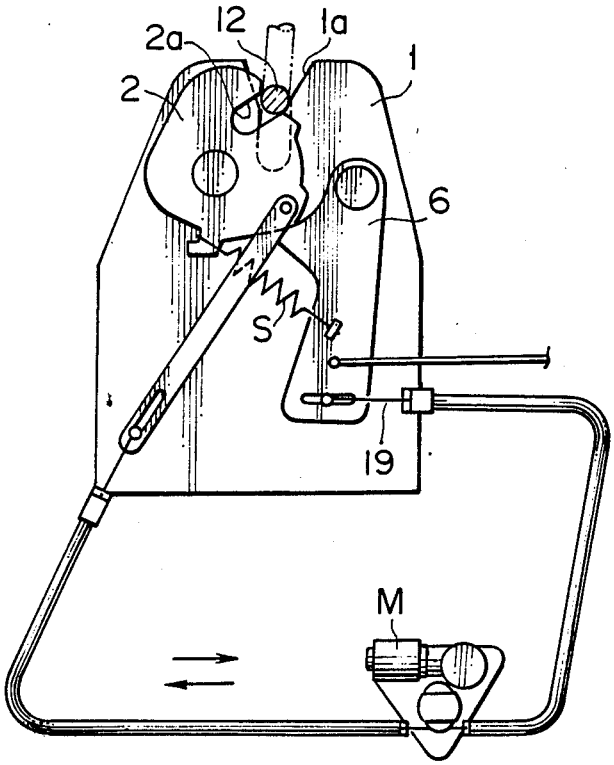
FIG. 4 PRIOR ART
FIG. 4 is a general view of a conventional device for locking a trunk lid.
Figure 5:
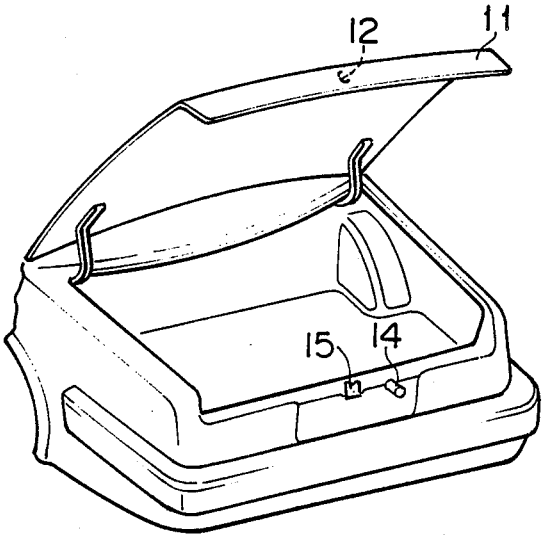
FIG. 5 PRIOR ART
FIG. 5 is a perspective view, similar to FIG. 2, showing the conventional device.

The same reference numerals are given in FIGS. 1-3 in the portions corresponding to those in FIGS. 4 and 5.

As shown in FIG. 2, a base plate 1 is secured to a rear edge part of a trunk structure 13 of a motor vehicle. The trunk structure 13 can be closed by a trunk lid 11. As shown in FIG. 1, a guide slot 1*a* is formed in an upper part of the base plate 1 for guiding into a locking position a striker 12 secured to the rear edge part of the trunk lid 11. A latch member 2 is pivotally supported by a pivot pin 2*c* fixed to the base plate 1. An engagement slot 2*a* formed in this latch member 2 functions cooperatively with the guide slot 1*a* to hold the striker 12 in the locked position. Furthermore, a detent lever 6 is pivotally supported by a pivot pin 6*c* on the base plate 1.

The detent lever 6 has a pawl part 6*a*, which engages with a catch part 2*d* of the latch member 2 to stop the rotation of the latch member 2 about the pivot pin 2*c*, so that the locked state is sustained by cooperative functioning of the engagement slot 2*a* and the guide slot 1*a*.

The latch member 2 and the detent lever 6 are connected by a tension spring S. This spring S exerts a constant spring force causing the pawl part 6*a* of the detent lever 6 to engage with the catch part 2*d* of the latch member 2.

A lock lever 4 is pivotally supported by a pivot pin 4*c* on the base plate 1 near the lower edge thereof. A roller 4*a* is rotatably supported on one end of the lever 4. A slot 4*b* is formed at the other end of the lever 4. The slot 4*b* is slidably engaged with a stud pin 5*b* projecting from and fixed to a sliding member 5.

The roller 4*a* of the lock lever 4 is interposed between a contact surface 2*b* of the latch member 2 and a contact surface 6*b* formed by bending a part of the detent lever 6, as shown in FIG. 3 which is a cross-sectional view along line III—III of FIG. 1. By swinging the lever 4 about its pivot pin 4*c*, the roller 4*a* of the lever 4 may press selectively the contact surface 2*b* of the latch member 2 or the contact surface 6*b* of the detent lever 6. The lock lever 4 is driven in a swinging movement by the reciprocal (left or right as viewed in FIG. 1) movement of the sliding member 5. The sliding member 5 is driven in turn on the wire guide 5*a* by reciprocal movement of a wire 5*c* driven by a motor M operating in forward or reverse rotation.

One end of a rod 7 is pivotally supported on a lower part of the detent lever 6, and the other end of the rod 7 is connected to a key type unlocking mechanism 14. By inserting and turning a master key, the pawl part 6*a* of the detent lever 6 is released from the catch part 2*d* of the latch member 2, whereby an unlocking condition is accomplished.

Operation of the device according to the present invention is as follows.

As shown in FIG. 2, the striker 12 is lowered to a fitting position in the engagement slot 2*a* by pushing the trunk lid 11 down. At the same time, the motor M is operated by a signal from a sensor 9 which monitors the fitting position of the striker 12, and the wire 5*c* is drawn in the direction of arrow A by the motor M.

The sliding member 5 secured to the end of the wire 5*c* is moved along the wire guide 5*a* in the direction of arrow A by the movement of the wire 5*c*. The lock lever 4 connected to the sliding member 5 through the slot 4*b*, and the stud pin 5*b* is rotated in the direction of arrow C. Then, the roller 4*a* on one end of the lever 4 presses the contact surface 2*b* of the latch member 2. The latch member 2 is rotated in the direction of arrow F about the pivot pin 2*c* against the force of the tension spring S.

The striker 12 fitted in the engagement slot 2*a* is lowered along the guide slot la towards the lower end thereof in accordance with the rotation of the latch member 2. The latch member 2 is further rotated until the catch part 2*d* is engaged with the pawl part 6*a* of the detent lever 6, thereby accomplishing a locking condition.

After the locking condition is accomplished, the motor M is operated in a reverse rotation so that the roller 4*a* on one end of the lever 4 is returned to a former position between the contact surface 2*b* of the latch member 2 and the contact, surface 6*b* of the detent lever 6. The roller 4*a* is located at this position. In this condition, as can be seen from FIG. 1, if the latch member 2 is released from the detent lever 6 by a pull on the rod 7, the latch member returns to a former unlocking position.

When the striker 12 is lowered faster by rapidly closing the trunk lid 11 rather than by the rotation of the latch member 2 driven by the motor M, the latch member 2 is rapidly rotated because of the contact with the striker 12. However, the impact upon the motor M, driving mechanisms, and are absorbed because the contact surface 2*b* of the latch member 2 is moved separately from the roller 4*a* of the lock lever 4. The locking condition is thus accomplished without exerting a bad influence upon the motor M.

The unlocking operation of the device is as follows.

In the locking condition, the motor M is operated in the direction reverse to that of the locking operation by manipulating a lid opening switch 10 provided in the motor vehicle interior. The wire 5*c* is drawn in the direction of arrow B. The sliding member 5 secured to the end of the wire 5*c*, is moved along the wire guide 5*a* in the direction of arrow B by the movement of the wire 5*c*. The lock lever 4 connected to the sliding member 5 through the slot 4*b* and the stud pin 5*b*, is rotated in the direction of arrow D reverse to that of locking operation. Then, the roller 4*a* on one end of the lever 4 presses the contact surface 6*b* of the detent lever 6, and the detent lever 6 is rotated in the direction of arrow G. The pawl part 6*a* of the detent lever 6 is released from the catch part 2*d* of the latch member 2 by the rotation of the detent lever 6. The latch member 2 is rotated in the direction of arrow E by the force of the tension spring S, thereby accomplishing the unlocking condition.

After the unlocking condition is accomplished, the motor M is operated so that the roller 4*a* on one end of the lever 4 is returned to the former position between the contact surface 2*b* of the latch member 2 and the contact surface 6*b* of the detent lever 6.

As described hereinabove, the wire 5*c* is used for connecting the motor M to the lock lever 4. However, it will be appreciated that a rod may be used instead of the wire. When a rod is used, the sliding member 5 and guide member such as the wire guide 5*a* may be omitted.

As mentioned above, when the trunk lid 11 is closed, the motor drives the lock lever 4 through the wire or the rod, and the latch member 2 rotated by the lock lever 4 moves forcibly the striker down. Thus the locking operation is made reliably with a reduced lid closing force.

When the trunk lid 11 is opened, the motor M operates in the reverse direction on the basis of the signal from the lid opening switch, and drives the lock lever 4 to rotate the detent lever 6. The detent lever 6 is thereby released from the latch member 2. In this case, it is not necessary to add other driving means, other wire and so on, and to provide escape slots in connecting portions. Thus the structure of the device becomes simple and the mechanical operation reliability is enhanced.

While the presently preferred embodiments of the present invention have been shown and described, it will be understood that the disclosure is for the purposes of illustration and that various changes and modifications may be made without departing from the scope of the invention as set forth in the appended claims.

What is claimed is:

1. A device for locking a trunk lid of a motor vehicle comprising:

a base plate secured to a trunk structure of the vehicle and provided with a guide slot for receiving a striker secured to the trunk lid;

a latch member rotatively supported on the base plate and provided with an engagement slot for functioning cooperatively with the guide slot to hold the striker and provided with a contact surface;

a detent lever pivotally supported on the base plate and being engageable with the latch member to hold the latch member in a locking position and provided with a contact surface;

a lock lever pivotally supported on the base plate and provided with a roller for engagement with said contact surface of the latch member or with said contact surface of the detent lever, whereby said roller is capable of rotating the latch member and the detent lever, respectively, the roller being located at a position between the contact surfaces in an unlocking state of the trunk lid;

a motor for driving the lock lever in forward and reverse directions through a connecting mechanism;

a striker monitoring sensor for monitoring a fitting position of the striker in the engagement slot when the trunk lid is closed, the sensor sending the monitoring signal to the motor to rotate the latch lever through the lock lever driven in the forward direction, and to thereby move the striker along the guide slot until the latch member is locked to the detent lever; and a lid opening switch for sending an opening signal to the motor to rotate the detent lever through the lock lever driven in the reverse direction, and to release the detent lever from the latch member.

2. The device as claimed in claim 1, wherein the connecting mechanism between the lock lever and the motor is a wire.

3. The device as claimed in claim 1, further comprising:

an unlocking mechanism secured to the trunk structure and cooperated with a master key; and a rod operatively connecting the detent lever to the unlocking mechanism for releasing the latch member from the detent lever depending on the operation of the master key, so as to accomplish the unlocking state of the trunk lid.

* * * * *